US005609929A

United States Patent [19]

Huang

[11] Patent Number: 5,609,929

[45] Date of Patent: Mar. 11, 1997

[54] DEVICE SHELL

[76] Inventor: Yung-Chung Huang, 3F, No. 36-4, Shu-Hsin Rd., Shu-Lin Chen, Taipei Hsien, Taiwan

[21] Appl. No.: 565,671

[22] Filed: Dec. 1, 1995

[51] Int. Cl.[6] ..... A63B 39/00

[52] U.S. Cl. ..... 428/11; 428/79

[58] Field of Search ..... 428/5, 11, 79

[56] References Cited

U.S. PATENT DOCUMENTS 600,610 3/1898 Cowles ..... 428/11 X 3,691,704 9/1972 Novak ..... 428/11 X

FOREIGN PATENT DOCUMENTS 782249 9/1957 United Kingdom ..... 428/11

*Primary Examiner*—Henry F. Epstein

*Attorney, Agent, or Firm*—Merchant, Gould, Smith, Edell, Welter & Schmidt, P.A.

[57] ABSTRACT

A device shell including a shell body consisting of a plurality of shell pieces fastened together, each shell piece being respectively molded from colored plastics in a predetermined pattern.

3 Claims, 5 Drawing Sheets

DEVICE SHELL

BACKGROUND OF THE INVENTION

The present invention relates to device shells, and relates more particularly to such a device shell which is comprised of a plurality of shell pieces respectively molded from plastics of different colors in different patterns and then fastened together by a ultrasonic heat sealing apparatus.

Regular electric devices such as motors, pendent lamps, etc., are generally equipped with a shell for protection as well as for decoration. In order to provide an attractive outer appearance, the shell of a device, after its fabrication, is generally paint-coated with a layer of color or pattern. However, this processing process requires much processing time and, relatively increases the manufacturing cost of the device.

SUMMARY OF THE INVENTION

The present invention has been accomplished under the circumstances in view. According to one embodiment of the present invention, the shell is made by molding plastics of different colors into different shell pieces of different patterns, and then fastening the shell pieces together into shape by a ultrasonic heat sealing apparatus. According to another embodiment of the present invention, the shell is comprised of an open frame structure, and a plurality of shell pieces respectively molded from plastics of different colors in different patterns and then fastened to the open frame structure by a ultrasonic heat sealing apparatus. According to still another embodiment of the present invention, the shell is comprised of a shell body injection molded from plastics, and a plurality of decorative shell pieces respectively injection-molded from plastics of different colors and then molded onto the shell body by a molding mold.

DETAILED DESCRIPTION OF THE PREFERRED EMBODIMENT

Figure 1:
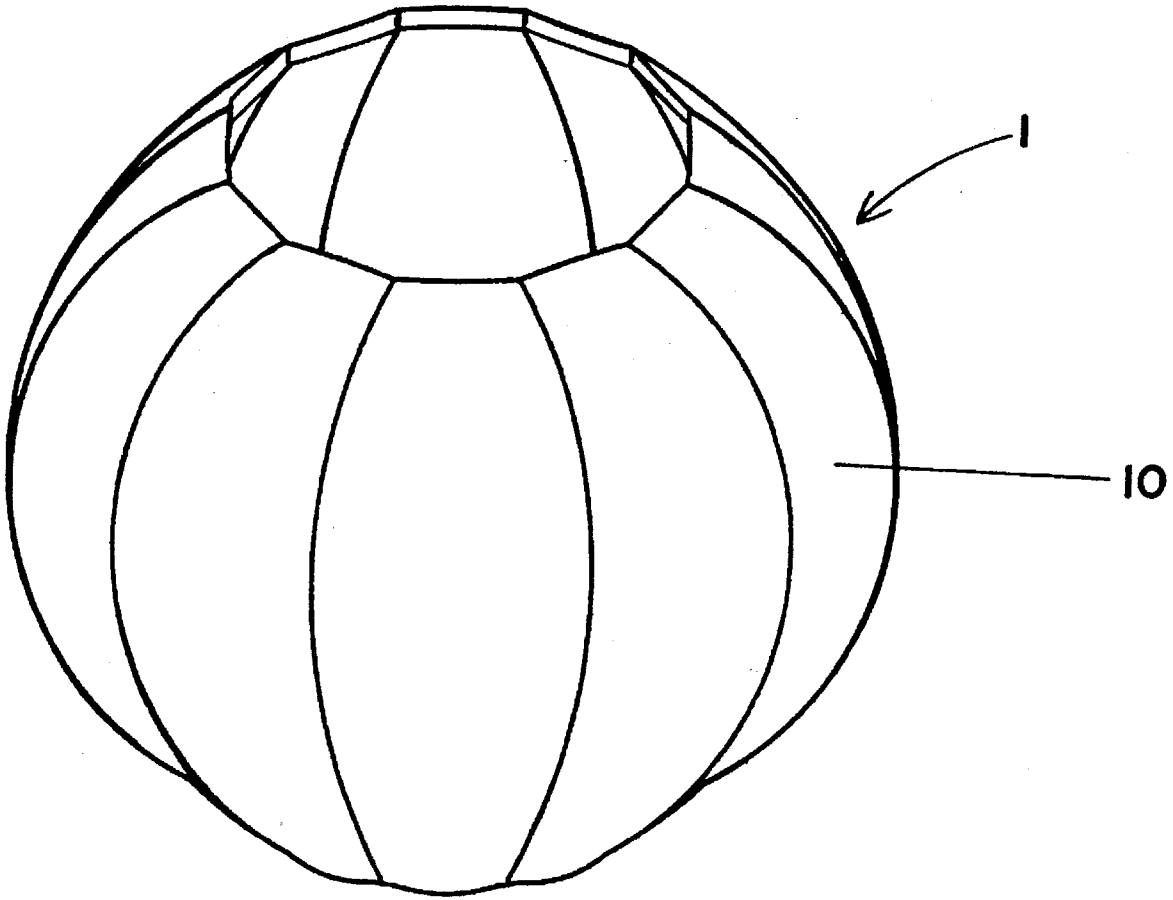
FIG. 1 is an elevational view of a device shell according to a first embodiment of the present invention.
Figure 2:
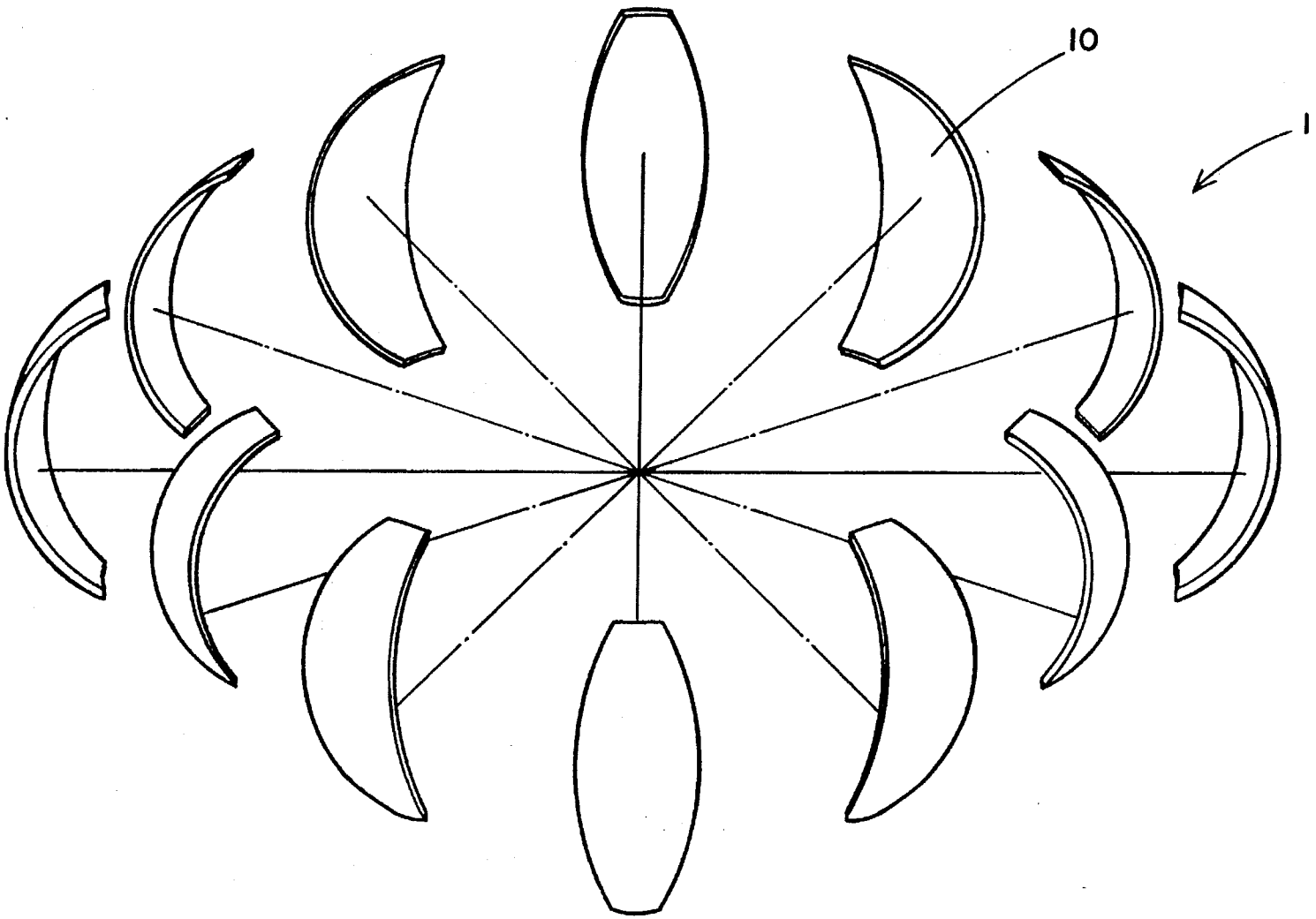
FIG. 2 is an exploded view of the device shell shown in FIG. 1.

Referring to FIGS. 1 and 2, the device shell, referenced by 1, is comprised of a plurality of shell pieces 10. The shell pieces 10 are injection-molded from plastics, and then fastened together by an ultrasonic heat sealing apparatus. The shell pieces 10 can be made of different colors and patterns, or of the same color and same pattern.

Figure 3:
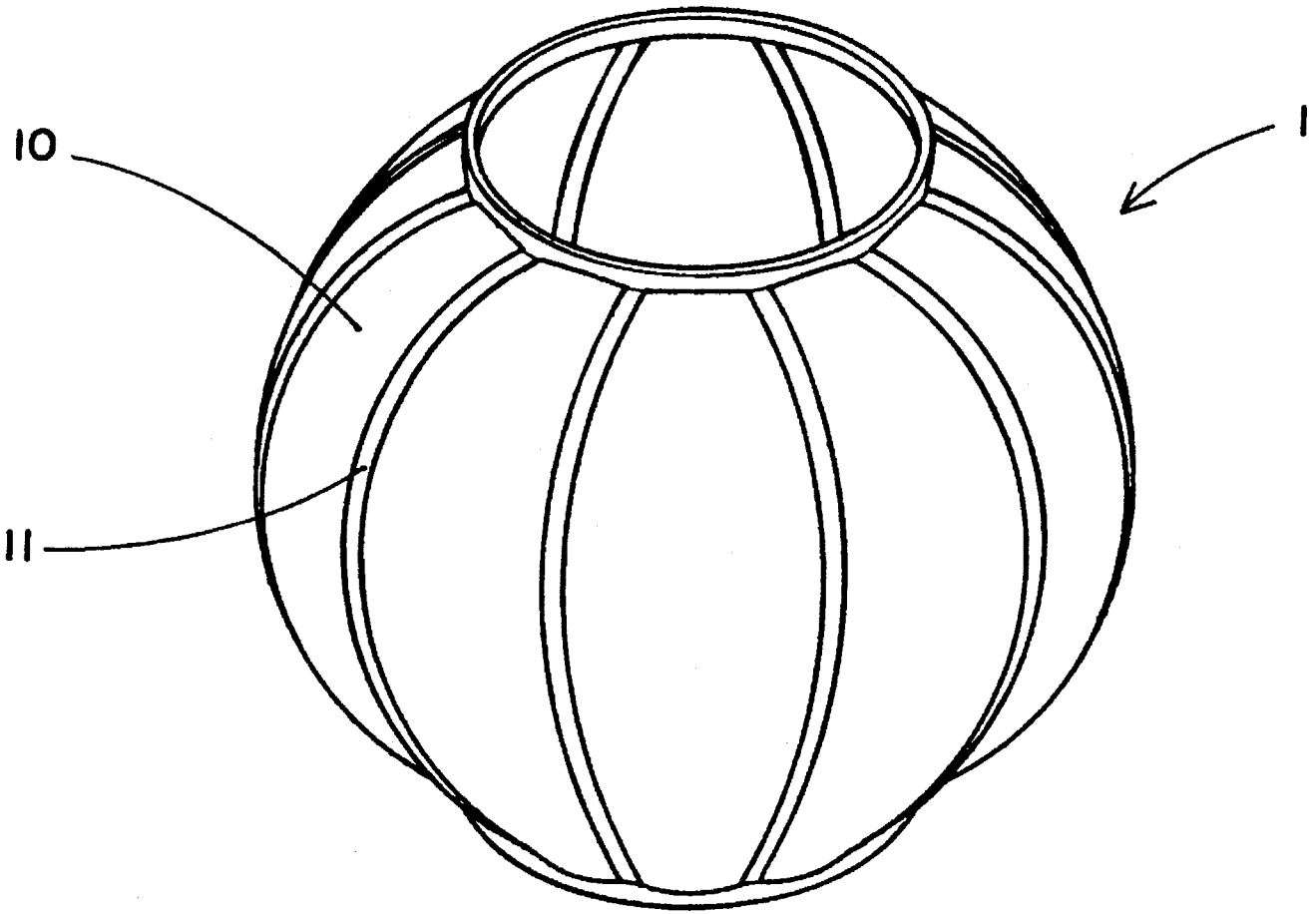
FIG. 3 is an elevational view of a device shell according to a second embodiment of the present invention.
Figure 4:
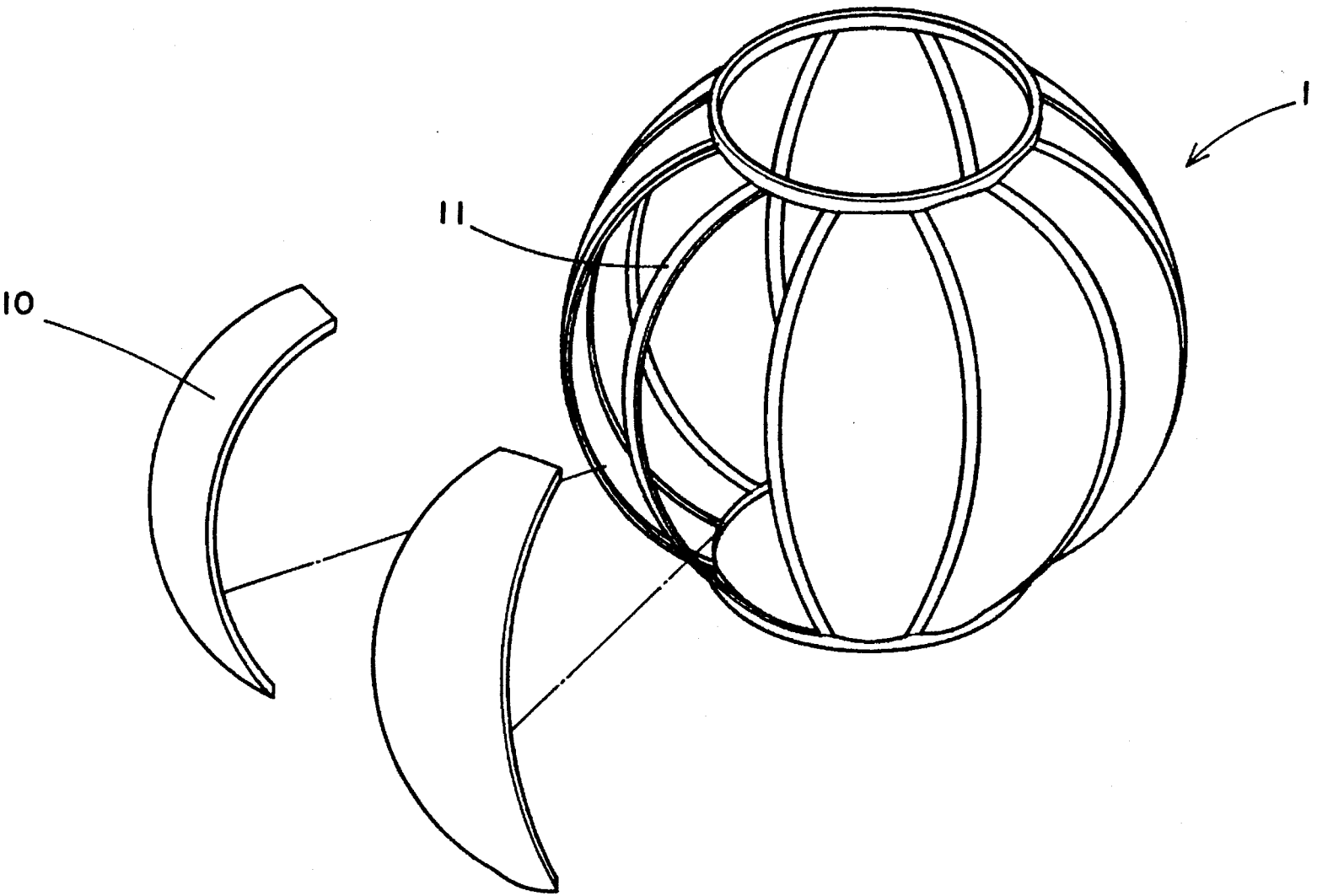
FIG. 4 is an exploded view of the device shell shown in FIG. 3.

FIGS. 3 and 4 shows a device shell according to a second embodiment of the present invention. According to this alternate form, the device shell 1 comprises an open frame structure 11, and a plurality of shell pieces 10 respectively fastened to the open frame structure 11 by an ultrasonic heat sealing apparatus, i.e., the shell pieces 10 are supported on the open frame structure 11 when installed.

Figure 5:
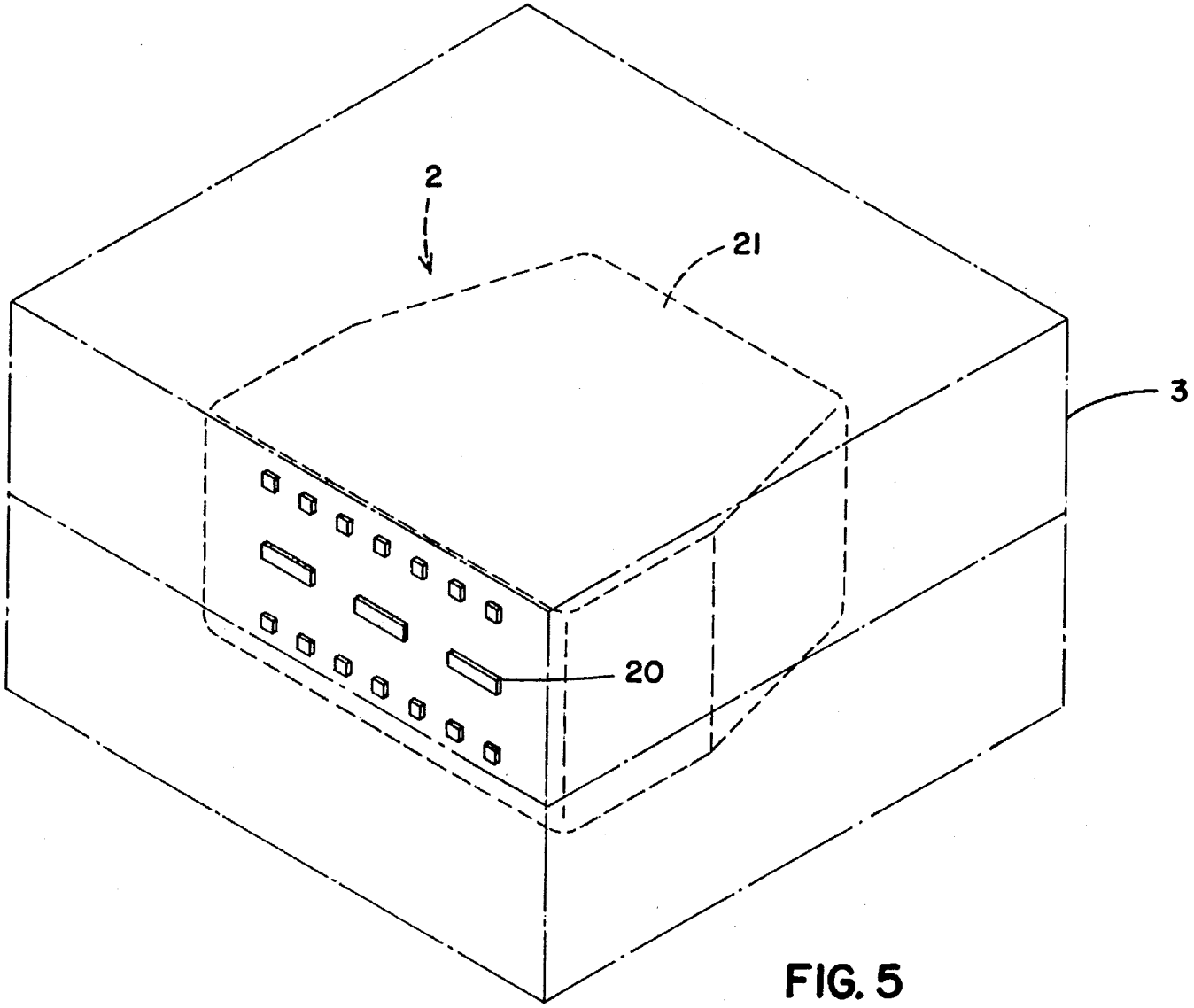
FIG. 5 shows the processing of a device shell according to a third embodiment of the present invention.

Referring to FIG. 5, the device shell, referenced by 2, comprises a shell body 21, and a plurality of decorative shell pieces 20 respectively injection-molded from plastics of different colors and/or patterns and then molded onto the shell body 20 by a molding mold 3.

It is to be understood that the drawings are designed for purposes of illustration only, and are not intended as a definition of the limits and scope of the invention disclosed.

I claim:

1. A device shell, comprising:

a shell body being made of a plurality of shell pieces, the shell pieces extending side by side with each other between a top end and a bottom end of the shell body, each of the shell pieces having an arc shape to form a ball-shape shell body upon the shell pieces being fastened together by a heat sealing process; and each shell piece being respectively molded from colored plastics in a predetermined pattern.

2. A device shell of claim 1 further comprising a plurality of decorative pieces respectively molded on said shell body, each of the decorative pieces being respectively molded from colored plastics in a predetermined pattern.

3. A device shell comprising:

a plurality of shell pieces, each of which has an arc shape;

an open frame structure, the open frame structure having supporting means for supporting and retaining the shell pieces thereon; and wherein the shell pieces are disposed side by side between a top end and a bottom end of the open frame structure.

* * * * *